United States Patent [19]

Saito

[11] Patent Number: 4,558,190

[45] Date of Patent: Dec. 10, 1985

[54] INPUT ELEMENT

[75] Inventor: Tetsuro Saito, Hiratsuka, Japan

[73] Assignee: Canon Kabushiki Kaisha, Tokyo, Japan

[21] Appl. No.: 594,867

[22] Filed: Mar. 29, 1984

[30] Foreign Application Priority Data

Mar. 31, 1983 [JP] Japan ..... 58-56221

[51] Int. Cl.[4] ..... H01H 9/00

[52] U.S. Cl. ..... 200/5 A; 200/159 B

[58] Field of Search ..... 200/5 A, 159 B

[56] References Cited

U.S. PATENT DOCUMENTS 4,467,151 8/1984 Johnson et al. ..... 200/159 B

*Primary Examiner*—A. D. Pellinen

*Assistant Examiner*—Morris Ginsburg

*Attorney, Agent, or Firm*—Fitzpatrick, Cella, Harper & Scinto

[57] ABSTRACT

An input element comprises a pair of spread substrates each having an electroconductive film, the electroconductive surfaces, facing each other and a spacer disposed between said substrates to surround the space. An electroconductive film of at least one of said substrates extends outside of the spacer, which comprises an elastic resin disposed at the crossing portion of the spacer and the electroconductive film extended outside of the spacer.

3 Claims, 2 Drawing Figures

INPUT ELEMENT

BACKGROUND OF THE INvENTION

1. Field of the Invention

The present invention relates to an input element such as a panel switch and more particularly, to a panel switch with enhanced reliability.

2. Description of the Prior Art

In recent years, panel switches have been used in combination with display scopes displaying outputs from computers. For example, by placing a panel switch upon a display scope, it is possible to make an electrical connection at a portion in the panel switch where a certain character, numeral, figure or the like on the display scope is touched with a finger tip, thereby displaying signals from an external electronic circuit on the display scope.

In these panel switches, there are formed transparent electroconductive films so as to form a matrix structure on a plastic substrate and a glass substrate arranged at the upper and lower portions in the panel switch, electroconductive films formed on the plastic substrate and the glass substrate are connected respectively with a external electronic circuit. Therefore, when one surface of this panel switch is touched with a finger tip, the upper and the lower electroconductive films are connected at the portion as touched to transmit signals from an external electronic circuit to the display scope. In such a panel switch, in order to connect the panel switch with an external electronic circuit, the electroconductive films are extended, across the spacer, outside thereof. Hence, this electroconductive film and the spacer form a crossing portion.

In this conventional panel switch, tension is applied to the upper substrate to prevent a misfunction due to an unintended contact between a pair of the electroconductive films, and a strong adhesive for holding the tension adheres to the end surface of the spacer.

When such a conventional panel switch is touched with finger tip to work it, the electroconductive film crossing the spacer adheres to the adhesive and then breaks away from the substrate to cause disconnection.

SUMMARY OF THE INVENTION

An object of the present invention is to provide a novel input element, particularly a panel switch, capable of preventing the disconnection.

Another object of the present invention is to provide an input element, particularly a panel switch, which is improved in reliability on repeated runs.

According to the present invention, there is provided an input element which comprises a pair of substrates having an electroconductive film, disposed at a distance to form a space therebetween, the electroconductive surface facing inside, and a spacer disposed between said substrates to surround the space, an electroconductive film of at least one of said substrates extending outside of the spacer, which comprises an elastic resin disposed at the crossing portion of the spacer and the electroconductive film extended outside of the spacer.

DESCRIPTION OF THE PREFERRED EMBODIMENT

As the elastic resin to be used in the present invention, there may be suitably mentioned polyester resin adhesives hardened under prescribed hardening (heating) conditions. Among these thermosetting polyester resin adhesives, preferred adhesives are ones containing unsaturated polyester resins prepared by using acrylic acid esters (for example, methyl acrylate, ethyl acrylate, etc.) as monomer component. More particularly, there may be mentioned acrylic acid ester emulsion adhesives prepared by polymerizing acrylic acid esters according to the emulsion polymerization process or acrylic acid ester adhesives prepared by polymerizing acrylic acid esters in the presence of polymerization initiators (benzoyl peroxide, methyl ethyl ketone peroxide, cumene hydroperoxide or the like). Particularly, in the present invention, it is preferred to use "Dotite XA-256" produced by Fujikura Kasei Co. which is an unsaturated polyester resin adhesive blended with silver particles.

The present invention is described below with reference to the drawings.

Figure 1:
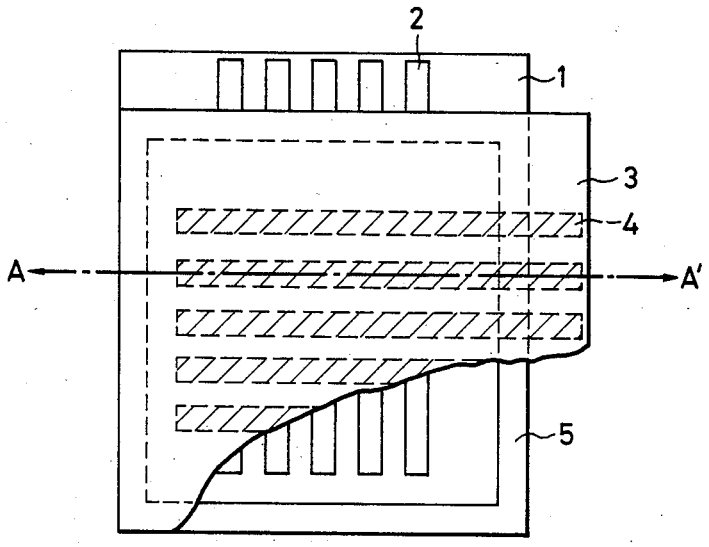
FIG. 1 is a plan view of the input element of the present invention.
Figure 2:
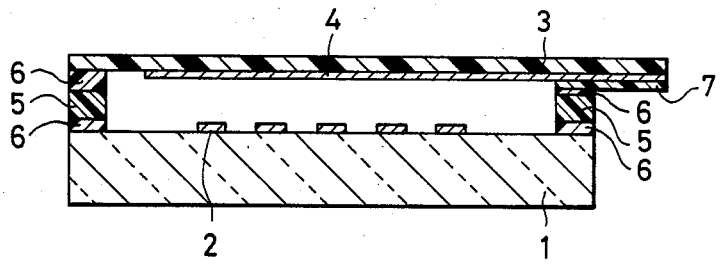
FIG. 2 is a sectional view taken along A—A' in FIG. 1.

The panel switch shown in FIGS. 1 and 2 is provided with the lower substrate 1 and the upper substrate 3, and the electroconductive films 2 formed on the lower substrate 1 and the electroconductive films 4 formed on the upper substrate 3 are distributed so as to form a matrix structure.

The upper substrate 3 is preferably constituted of a flexible material, and generally, there may be employed a plastic plate (polyester resin plate, acrylic resin plate and the like). As the lower substrate 1, there may be employed a glass plate. The electroconductive films 2 and 4 are preferably transparent films, and generally, there may be preferably used indium oxide ($In_2O_3$), tin oxide ($SnO_2$) or ITO ($In_2O_3/SnO_2$).

The electroconductive films 2 and 4 are respectively extended outside of the spacer 5 to be connected with an external electronic circuit (not shown) at the extended portion, and therefore there are formed crossing portions between the extended portions and the spacer 5. As the spacer 5, there may be employed a frame-shaped film having a thickness of about $10\mu$ to $500\mu$ constituted of plastic such as polyester resin, and the spacer 5 is fixed at both sides thereof with a strong adhesive 6 such as an epoxy resin adhesive. The elastic resin 7 is positioned at the portion on the electroconductive film 4 crossing the spacer 5.

A preparation example of a panel switch of the present invention is shown below.

PREPARATION EXAMPLE

On an $In_2O_3/5\%SnO_2$ (hereinafter simply referred to as "ITO") film of the polyester (polyethylene terephthalate) film provided with ITO film "IODTORI" (trade name) produced by Teijin Co., there was printed an acid resisting resist by a screen printing to give such a pattern that the electroconductive film formed on the upper substrate as shown in FIG. 1 was formed. This film was then etched by immersing it in an etching liquor (a mixture of HCl and $FeCl_3$), and the resist was removed from this film, followed by rinsing and drying. The film thus dried was cut into desired sizes.

On the portion to be the crossing portion as described below of this electroconductive film formed on the upper substrate, there was printed "Dotite XA-256" (mfd. by Fujikura Kasei Co.) which is a polyester resin adhesive blended with silver particles, and then a heat curing was effected at 100° C. for an hour.

Next, there was prepared a glass substrate having the same electroconductive film pattern as that formed on the lower substrate shown in FIG. 1 according to the procedure as described above.

Then, to both surfaces of the polyester film having a thickness of 100 μm as punched into a frameshape with a punching machine, there was applied an epoxy resin adhesive produced by Ciba Ltd. (a mixture of an epoxy resin "Araldite AW-106" and an amine hardner "Hardner HV-935U"). After one surface coated with the adhesive was adhered to the prescribed position on the lower substrate, the upper substrate was placed upon the other surface coated with the adhesive while applying a tension and a heat curing was effected at 100° C. for 10 minutes to harden the adhesive.

In order to evaluate the reliability of the panel switch thus prepared, a test was conducted to determine how many times of repeated pushing by a mechanical means cause a continuity defect.

Disconnection did not occur even when pushing was repeated 50000 times.

On the other hand, a panel switch for comparison was prepared according to the same procedure as that described above except that "DotiteXA-256" was not used. This panel switch for comparison was subjected to the same test for evaluating reliablity as that conducted above. It was confirmed that, in this case, a disconnection occurred after 5000 times of pushing.

What I claim is:

1. An input element comprising:

(a) a pair of substrates each having an electroconductive film disposed at a distance to form a space therebetween, the electroconductive film facing each other; and (b) a spacer disposed between said substrates to surround the space, the electroconductive film of at least one of said substrates extending outside of the spacer, which is adhered by an elastic resin formed by curing an electroconductive adhesive disposed at the crossing portion of the spacer and the electroconductive film extended beyond said crossing portion of the spacer.

2. An input element according to claim 1 in which said elastic resin is a polyester resin adhesive hardened under prescribed hardening conditions.

3. An input element according to claim 1 in which the spacer is adhered to the substrate with an epoxy resin adhesive.

* * * * *

UNITED STATES PATENT AND TRADEMARK OFFICE

CERTIFICATE OF CORRECTION

PATENT NO. : 4,558,190

DATED : December 10, 1985

INVENTOR(S) : TETSURO SAITO

It is certified that error appears in the above-identified patent and that said Letters Patent is hereby corrected as shown below:

IN THE ABSTRACT

Line 3, change "surfaces, facing" to --surfaces facing--.

Column 1, line 4, change "INvENTION" to --INVENTION--;
line 24, change "a" to --an--; and
line 42, change "with finger tip" to --with a finger tip--.

Column 3, line 8, change "frameshape" to --frame-shape--;
line 11, change "hardner" to --hardener--; and
line 26, change "DotiteXA-256" to --Dotite XA-256--.

Column 5, line 9, change "film" to --films--.

Signed and Sealed this

Twenty-first Day of October, 1986

[SEAL]

*Attest:*

DONALD J. QUIGG

*Attesting Officer* *Commissioner of Patents and Trademarks*